US009822507B2

(12) United States Patent
Singh et al.

(10) Patent No.: US 9,822,507 B2
(45) Date of Patent: Nov. 21, 2017

(54) WORK VEHICLE WITH ENHANCED IMPLEMENT POSITION CONTROL AND BI-DIRECTIONAL SELF-LEVELING FUNCTIONALITY

(71) Applicant: CNH Industrial America, LLC, New Holland, PA (US)

(72) Inventors: Aditya Singh, Paradesh (IN); Duqiang Wu, Saskatoon (CA); Navneet Gulati, Gujarat (IN)

(73) Assignee: CNH Industrial America LLC, New Holland, PA (US)

( * ) Notice: Subject to any disclaimer, the term of this patent is extended or adjusted under 35 U.S.C. 154(b) by 128 days.

(21) Appl. No.: 14/557,512

(22) Filed: Dec. 2, 2014

(65) Prior Publication Data

US 2016/0153165 A1 Jun. 2, 2016

(51) Int. Cl.
*E02F 3/43* (2006.01)
*E02F 9/20* (2006.01)

(52) U.S. Cl.
CPC ..... *E02F 3/433* (2013.01); *E02F 9/2029* (2013.01)

(58) Field of Classification Search
None
See application file for complete search history.

(56) References Cited

U.S. PATENT DOCUMENTS 4,844,685 A 7/1989 Sagaser
5,160,239 A 11/1992 Allen et al.
5,184,932 A 2/1993 Misuda et al.
5,308,219 A * 5/1994 Lee ..... E02F 3/435 414/695.5
5,329,441 A 7/1994 Aoki et al.
5,356,260 A 10/1994 Ikari et al.
5,424,623 A 6/1995 Allen et al.
5,797,310 A * 8/1998 Casey ..... E02F 3/433 60/424
5,807,061 A 9/1998 Donoghue et al.
5,941,921 A * 8/1999 Dasys ..... E02F 3/434 414/699

(Continued)

OTHER PUBLICATIONS

SAE International—web page. An Efficient Lift Control Technique in Electrohydraulic Camless Valvetrain Using Variable Speed Hydraulic Pump. Dated: Apr. 12, 2011 (One page).

*Primary Examiner* — Ryan Rink
(74) *Attorney, Agent, or Firm* — Peter K. Zacharias; Patrick M. Sheldrake

(57) ABSTRACT

A method for automatically adjusting the position of an implement of a lift assembly may generally include receiving a signal indicative of a position and/or a movement parameter of loader arms of the lift assembly and receiving a signal indicative of a pressure of a hydraulic fluid supplied within the lift assembly. The method may also include calculating a first correction signal associated with adjusting the position of the implement, wherein the correction signal is calculated by inputting the position and/or the movement parameter and the fluid pressure into a control equation based on a model of the operational dynamics of the lift assembly. In addition, the method may include generating a valve command signal based at least in part on the correction signal and transmitting the valve command signal to a valve for maintaining the implement at a fixed orientation relative as the loader arms are being moved.

18 Claims, 3 Drawing Sheets

(56) References Cited

U.S. PATENT DOCUMENTS 5,974,352 A 10/1999 Shull
6,019,202 A * 2/2000 Anwar ..... B60W 10/02 192/13 R
6,098,322 A * 8/2000 Tozawa ..... E02F 3/437 37/414
6,098,823 A 8/2000 Yahiaoui
6,233,511 B1 5/2001 Berger et al.
6,356,829 B1 3/2002 Fan et al.
6,633,804 B2 10/2003 Dix et al.
6,763,619 B2 7/2004 Hendron et al.
6,863,502 B2 3/2005 Bishop et al.
7,140,830 B2 11/2006 Berger et al.
7,426,423 B2 9/2008 Schneider et al.
7,530,185 B2 5/2009 Trifunovic
7,949,449 B2 5/2011 Koch et al.
8,396,607 B2 3/2013 Hirst
8,463,508 B2 6/2013 Nicholson et al.
8,612,103 B2 12/2013 Nicholson et al.
2004/0267404 A1* 12/2004 Danko ..... B25J 9/1607 700/245
2007/0168100 A1* 7/2007 Danko ..... B25J 9/1628 701/50
2007/0181361 A1* 8/2007 Stratton ..... E02F 3/847 180/315
2008/0263908 A1* 10/2008 Schoenmaker ..... E02F 3/434 37/348
2009/0143896 A1* 6/2009 Janardhan ..... E02F 9/264 700/213
2011/0006023 A1 1/2011 Schneider et al.
2011/0191003 A1* 8/2011 Laval ..... B62D 11/003 701/99
2012/0057956 A1 3/2012 Shirao et al.
2013/0004282 A1 1/2013 Grimes et al.
2013/0045071 A1 2/2013 Atkinson
2013/0081383 A1 4/2013 Knussman
2014/0060018 A1 3/2014 Ma et al.
2014/0116038 A1 5/2014 Pfaff et al.
2014/0196448 A1* 7/2014 Matsuzaki ..... F15B 11/165 60/459
2014/0214295 A1 7/2014 Elliott
2015/0322649 A1* 11/2015 Fleischmann ..... A01G 23/00 701/50

* cited by examiner

WORK VEHICLE WITH ENHANCED IMPLEMENT POSITION CONTROL AND BI-DIRECTIONAL SELF-LEVELING FUNCTIONALITY

FIELD OF THE INVENTION

The present subject matter relates generally to work vehicles and, more particularly, to a system and method for automatically adjusting the orientation or angular position of an implement of a work vehicle using closed-loop control so as to provide bi-directional self-leveling functionality as the vehicle's boom or loader arms are being moved.

BACKGROUND OF THE INVENTION

Work vehicles having lift assemblies, such as skid steer loaders, telescopic handlers, wheel loaders, backhoe loaders, forklifts, compact track loaders and the like, are a mainstay of construction work and industry. For example, skid steer loaders typically include a lift assembly having a pair of loader arms pivotally coupled to the vehicle's chassis that can be raised and lowered at the operator's command. In addition, the lift assembly includes an implement attached to the ends of the loader arms, thereby allowing the implement to be moved relative to the ground as the loader arms are raised and lowered. For example, a bucket is often coupled to the loader arms, which allows the skid steer loader to be used to carry supplies or particulate matter, such as gravel, sand, or dirt, around a worksite.

When using a work vehicle to perform a material moving operation or any other suitable operation, it is often desirable to maintain the vehicle's bucket or other implement at a constant angular position relative to the vehicle's driving surface (or relative to any other suitable reference point or location) as the loader arms are being raised and/or lowered. To achieve such control, conventional work vehicles typically rely on the operator manually adjusting the position of the implement as the loader arms are being moved. Unfortunately, this task is often quite challenging for the operator and can lead to materials being inadvertently dumped from the implement. To solve this problem, control systems have been disclosed that attempt to provide a control algorithm for automatically maintaining a constant angular implement position as the vehicle's loader arms are being moved. However, such previously disclosed automatic control systems still suffer from many drawbacks, including poor system responsiveness and imprecise implement position control. In particular, previously disclosed control systems have been unable to properly accommodate the non-linearity of the operational dynamics of the lift assembly as the loader arms are being moved, thereby providing less than desirable results.

Accordingly, an improved system and method for automatically adjusting the position of an implement of a work vehicle so as to maintain the implement at a desired angular orientation relative to a given reference point would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for automatically adjusting the position of an implement of a lift assembly for a work vehicle, wherein the lift assembly includes a pair of loader arms coupled to the implement. The method may generally include receiving a signal indicative of at least one of a position or a movement parameter of the loader arms as the loader arms are being moved, receiving a signal indicative of a fluid pressure of a hydraulic fluid supplied within the lift assembly and accessing a control equation that is based at least partially on a model of operational dynamics associated with the lift assembly when moving the loader arms. The method may also include calculating a first correction signal associated with adjusting the position of the implement, wherein the first correction signal is calculated by inputting the position and/or the movement parameter and the fluid pressure into the control equation. In addition, the method may include generating a valve command signal based at least in part on the first correction signal and transmitting the valve command signal to a valve associated with the implement in order to maintain the implement at a fixed orientation relative to a given reference point as the loader arms are being moved.

In another aspect, the present subject matter is directed to a method for automatically adjusting the position of an implement of a lift assembly for a work vehicle, wherein the lift assembly includes a pair of loader arms coupled to the implement. The method may generally include receiving a signal indicative of at least one of a position or a movement parameter of the loader arms and the implement as the loader arms are being moved, calculating an error signal based at least in part on the difference between the position and/or the movement parameter for the implement and at least one of a desired position or a desired movement parameter for the implement, receiving a signal indicative of a fluid pressure of a hydraulic fluid supplied within the lift assembly and accessing a control equation that is based at least partially on a model of operational dynamics associated with the lift assembly when moving the loader arms, wherein the control equation corresponds to a sliding mode control algorithm. The method may also include generating a model-based correction signal associated with adjusting the position of the implement, wherein the model-based correction signal is generated by inputting the position and/or the movement parameter for the loader arms, the fluid pressure and the error signal into the control equation. In addition, the method may include generating a valve command signal based at least in part on the model-based correction signal and transmitting the valve command signal to a valve associated with the implement in order to maintain the implement at a fixed orientation relative to a given reference point as the loader arms are being moved.

In a further aspect, the present subject matter is directed to a method for automatically adjusting the position of an implement of a lift assembly for a work vehicle, wherein the lift assembly includes a pair of loader arms coupled to the implement. The method may generally include receiving a signal indicative of at least one of a position or a movement parameter of the loader arms as the loader arms are being moved, receiving a signal indicative of a fluid pressure of a hydraulic fluid supplied within the lift assembly, generating a valve command signal based at least in part on the fluid pressure and the at least one of the position or the movement parameter and transmitting the valve command signal to a valve associated with the implement in order to maintain the implement at a fixed orientation relative to a given reference point as the loader arms are being moved.

In yet another aspect, the present subject matter is directed to a system for controlling the operation of a work vehicle.

The system may generally include a lift assembly having an implement and a pair of loader arms coupled to the implement. The system may include a tilt valve in fluid communication with a corresponding tilt cylinder. The tilt valve may be configured to control a supply of hydraulic fluid to the tilt cylinder in order to adjust the position of the implement relative to the loader arms. In addition, the system may include a controller communicatively coupled to the tilt valve. The controller may include at least one processor and associated memory. The memory may store instructions that, when implemented by the processor(s), configure the controller to receive a signal indicative of at least one of a position or a movement parameter of the loader arms as the loader arms are being moved, receive a signal indicative of a fluid pressure of a hydraulic fluid supplied within the lift assembly, access a control equation that is based at least partially on a model of operational dynamics associated with the lift assembly when moving the loader arms and calculate a first correction signal associated with adjusting the position of the implement, wherein the first correction signal is calculated by inputting the position and/or the movement parameter and the fluid pressure into the control equation. The controller may also be configured to generate a valve command signal based at least in part on the first correction signal and transmit the valve command signal to the tilt valve in order to maintain the implement at a fixed orientation relative to a given reference point as the loader arms are being moved.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
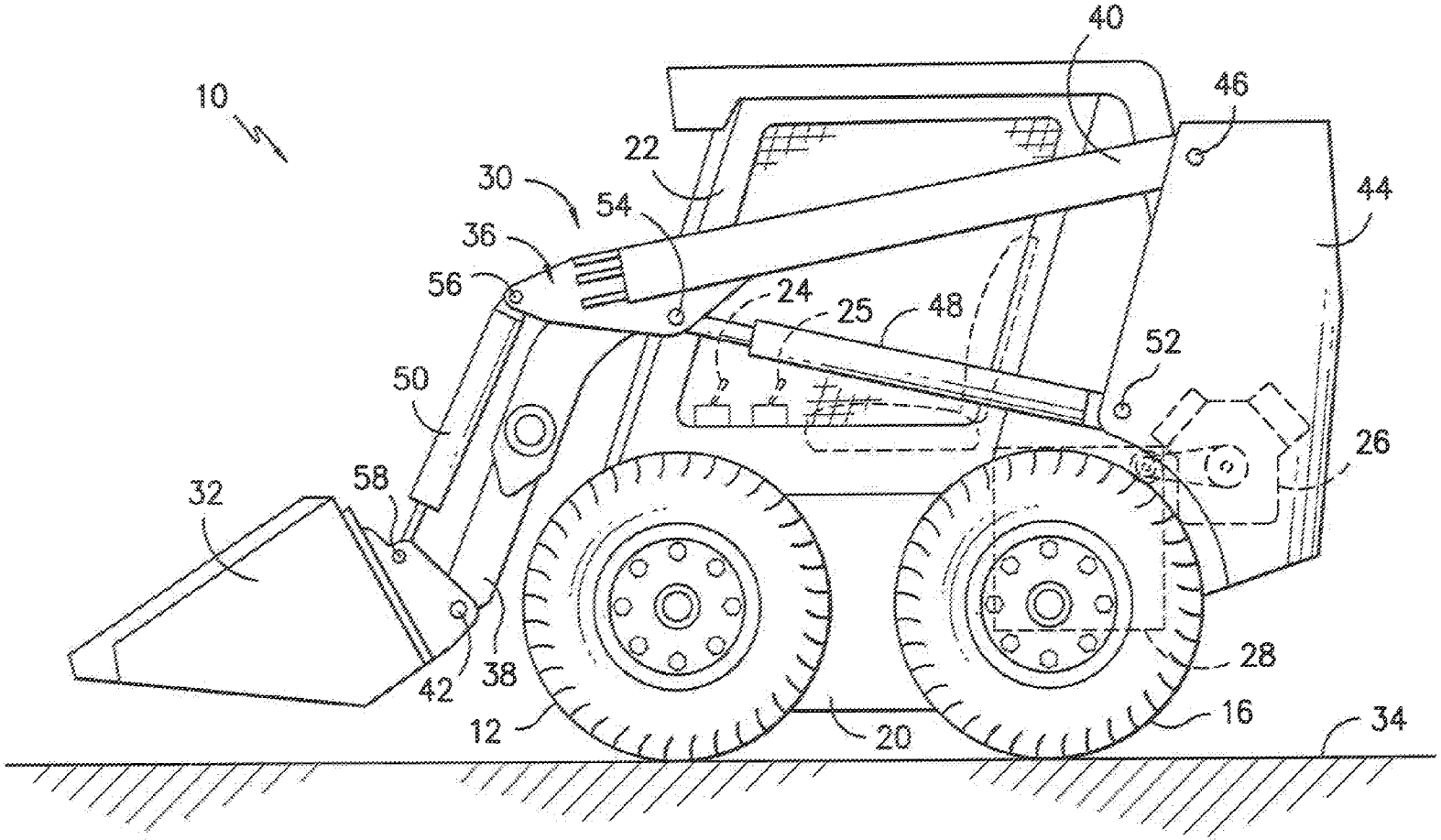
FIG. 1 illustrates a side view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for automatically adjusting the position of an implement of a work vehicle in order to maintain the implement at a fixed or constant angular orientation relative to a given reference point as the vehicle's loaders arms are being raised or lowered. In several embodiments, such control of the position of the implement may be achieved using a closed-loop control algorithm having a feed-forward portion, a feedback portion and/or a forcing portion to generate one or more correction factors for modifying the valve command signal(s) transmitted to the valve(s) used to adjust the position of the implement. Specifically, as will be described below, the feed-forward control portion of the closed-loop algorithm may derive from a control equation based on a mathematical model of the operational dynamics of the vehicle's lift assembly. The feed-forward control portion may be utilized to generate a dynamics-based correction factor corresponding to a valve command signal for adjusting the position of the implement. This dynamics-based correction factor may generally allow for the system's overall responsiveness to be increased, thereby increasing the accuracy of the implement position control. In addition, the feedback control portion of the closed-loop control algorithm may be configured to utilize an error signal based on the difference between a desired and an actual position/movement parameter for the implement to generate an error-based correction factor corresponding to a valve command signal that takes into account certain variables that may not otherwise be accounted for by the feed-forward control, thereby further increasing the accuracy with respective to controlling the position of the implement. Moreover, the forcing control portion may be utilized to generate a forcing correction factor corresponding to a valve command signal that accounts for any inaccuracies within the base mathematical model being utilized, thereby enhancing the overall accuracy and robustness of the system. The various correction factors or valve command signals generated by the feed-forward, feedback and forcing control portions of the closed-loop control algorithm may then be combined to generate a final valve control command for controlling the movement of the implement as the loader arms are being raised or lowered. In particular, the valve control command may be transmitted to the valve(s) controlling the supply of hydraulic fluid to the cylinder(s) associated with the implement. In such instance, the operation of the valve(s) may be controlled such that the cylinder(s) adjust the position of the implement in a manner that maintains the implement at the desired angular orientation relative to the vehicle's driving surface (or relative to any other suitable reference point).

In several embodiments, the closed-loop control algorithm described herein may incorporate aspects of and/or may correspond to a sliding mode control algorithm. Specifically, in a particular embodiment of the present subject matter, aspects of the feed-forward and feedback control portions may be integrated into or otherwise form part of a control equation implementing a sliding mode controller designed to increase the accuracy of the disclosed system. For example, based on the modeled operational dynamics of the vehicle's lift assembly, a non-linear sliding mode control design equation may be provided that improves the bandwidth of the closed-loop system, thereby increasing the system's responsiveness. Such a non-linear control design is best suited to account for the non-linearity of the various system dynamics, thereby providing numerous advantages over conventional control systems.

Referring now to the drawings, FIG. 1 illustrates a side view of one embodiment of a work vehicle 10 in accordance with aspects of the present subject matter. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As shown, the work vehicle 10 includes a pair of front wheels 12, (one of which is shown), a pair of rear wheels 16 (one of which is shown) and a chassis 20 coupled to and supported by the wheels 12, 16. An operator's cab 22 may be supported by a portion of the chassis 20 and may house various input devices, such as one or more speed control lever(s) 24 and one or more lift/tilt lever(s) 25, for permitting an operator to control the operation of the work vehicle 10. In addition, the work vehicle 10 may include an engine 26 and a hydrostatic drive unit 28 coupled to or otherwise supported by the chassis 20.

Moreover, as shown in FIG. 1, the work vehicle 10 may also include a lift assembly 30 for raising and lowering a suitable implement 32 (e.g., a bucket) relative to a driving surface 34 of the vehicle 10. In several embodiments, the lift assembly 30 may include a pair of loader arms 36 (one of which is shown) pivotally coupled between the chassis 20 and the implement 32. For example, as shown in FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arms 36 and a pair of hydraulic tilt cylinders 50 coupled between the loader arms 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arms 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arms 36 about the forward pivot point 42, thereby controlling the tilt angle or orientation of the implement 32 relative to the driving surface 34. As will be described below, by automatically controlling the operation of the tilt cylinders 50 (e.g., via their associated valve(s)) based on the closed-loop control algorithm disclosed herein, the orientation or angle of the implement 32 relative to the driving surface 34 (or relative to any other suitable reference point) may be maintained constant as the loader arms are being moved in response to operator-initiated inputs. Accordingly, if the operator desires for the implement 32 to be maintained at a 5° angle relative to the vehicle's driving surface 34 (or at any other suitable angle), the actuation of the tilt cylinders 50 may be automatically controlled such that the desired angular orientation is maintained as the loader arms 36 are pivoted about the rear pivot point 46.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
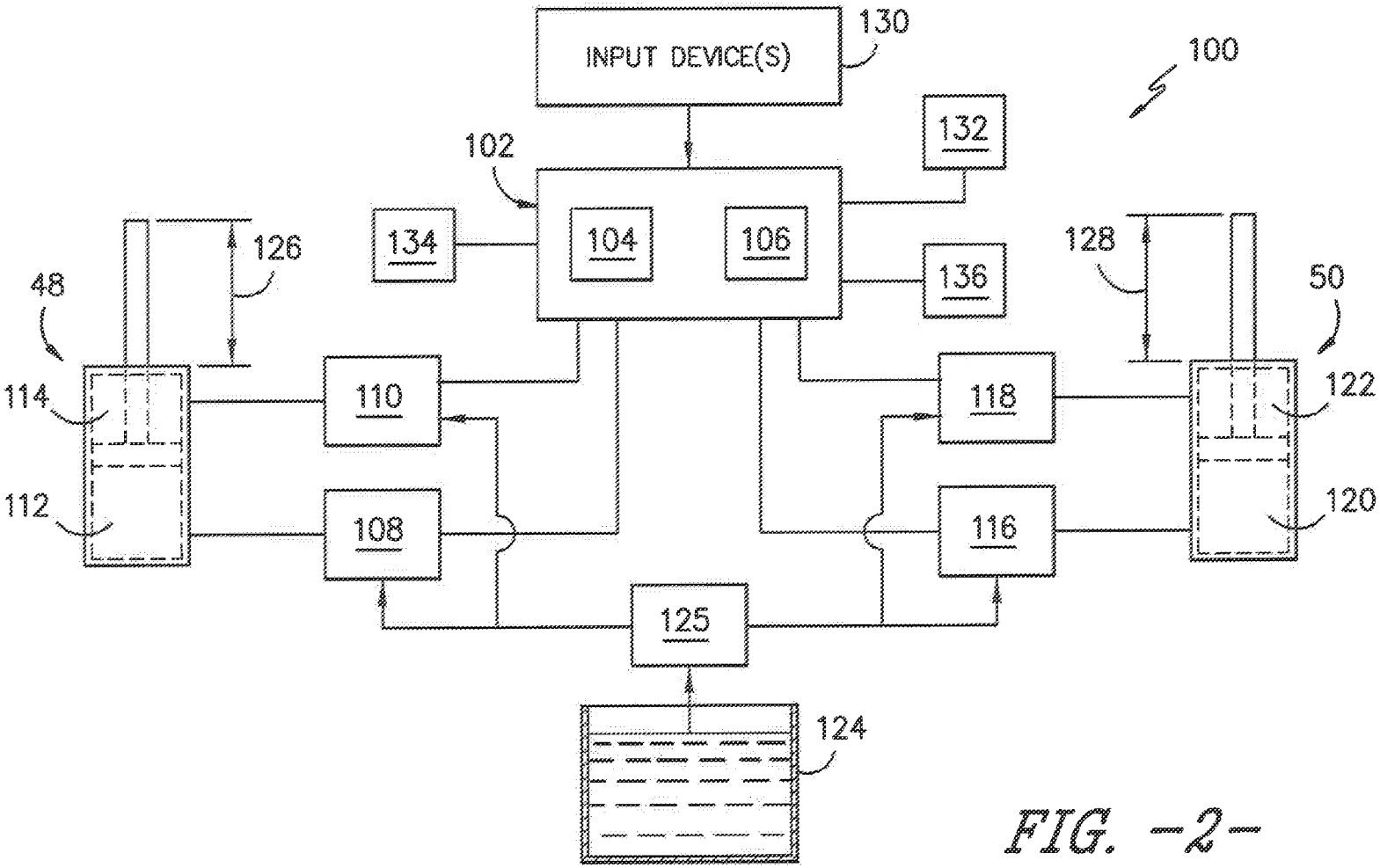
FIG. 2 illustrates a schematic view of one embodiment of a suitable control system for controlling various components of a work vehicle in accordance with aspects of the present subject matter, particularly illustrating the control system configured for controlling various hydraulic components of the work vehicle, such as the hydraulic cylinders and associated valves of the work vehicle.

Referring now to FIG. 2, one embodiment of a control system 100 suitable for automatically controlling the various lift assembly components of a work vehicle is illustrated in accordance with aspects of the present subject matter. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a controller 102 configured to electronically control the operation of one or more components of the work vehicle 10, such as the various hydraulic components of the work vehicle 10 (e.g., the lift cylinders 48, the tilt cylinders 50 and/or the associated valve(s)). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the closed-loop control algorithm 200 described below with reference to FIG. 3. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 48, 50 of the work vehicle 10. For example, the controller 102 may be communicatively coupled to suitable valves 108, 110 (e.g., solenoid-activated valves) configured to control the supply of hydraulic fluid to each lift cylinder 48 (only one of which is shown in FIG. 2). Specifically, as shown in the illustrated embodiment, the system 100 may include a first lift valve 108 for regulating the supply of hydraulic fluid to a cap end 112 of each lift cylinder 48. In addition, the system 100 may include a second lift valve 110 for regulating the supply of hydraulic fluid to a rod end 114 of each lift cylinder 48. Moreover, the controller 102 may be communicatively coupled to suitable valves 116, 118 (e.g., solenoid-activated valves) configured to regulate the supply of hydraulic fluid to each tilt cylinder 50 (only one of which is shown in FIG. 2). For example, as shown in the illustrated embodiment, the system 100 may include a first tilt valve 116 for regulating the supply of hydraulic fluid to a cap end 120 of each tilt cylinder 50 and a second tilt valve 118 for regulating the supply of hydraulic fluid to a rod end 122 of each tilt cylinder 50.

During operation, the controller 102 may be configured to control the operation of each valve 108, 110, 116, 118 in order to control the flow of hydraulic fluid supplied to each of the cylinders 48, 50 from a suitable hydraulic tank 124 of the work vehicle 10 via an associated pump 125. For instance, the controller 102 may be configured to transmit suitable control commands to the lift valves 108, 110 in order to regulate the flow of hydraulic fluid supplied to the cap and rod ends 112, 114 of each lift cylinder 48, thereby allowing for control of a stroke length 126 of the piston rod associated with each cylinder 48. Of course, similar control commands may be transmitted from the controller 102 to the tilt valves 116, 118 in order to control a stroke length 128 of the tilt cylinders 50. Thus, by carefully controlling the actuation or stroke length 126, 128 of the lift and tilt cylinders 48, 50, the controller 102 may, in turn, be configured to automatically control the manner in which the loader arms 36 and the implement 32 are positioned or oriented relative to the vehicle's driving surface 34 and/or relative to any other suitable reference point.

It should be appreciated that the current commands provided by the controller 102 to the various valves 108, 110, 116, 118 may be in response to inputs provided by the operator via one or more input devices 130. For example, one or more input devices 130 (e.g., the lift/tilt lever(s) 25 shown in FIG. 1) may be provided within the cab 22 to allow the operator to provide operator inputs associated with controlling the position of the loader arms 36 and the implement 32 relative to the vehicle's driving surface 34 (e.g., by varying the current commands supplied to the lift and/or tilt valves 108, 110, 116, 118 based on operator-initiated changes in the position of the lift/tilt lever(s) 25). Alternatively, the current commands provided to the various valves 108, 110, 116, 118 may be generated automatically based on a suitable control algorithm being implemented by the controller 102. For instance, as will be described in detail below, the controller 102 may be configured to implement a closed-loop control algorithm for automatically controlling the angular orientation of the implement 32. In such instance, output signals or valve control commands generated by the controller 102 when implementing the closed-loop control algorithm may be automatically transmitted to the tilt valve(s) 116, 118 to provide for precision control of the angular orientation/position of the implement 32.

Additionally, it should be appreciated that the work vehicle 10 may also include any other suitable input devices 130 for providing operator inputs to the controller 102. For instance, in accordance with aspects of the present subject matter, the operator may be allowed to select/input an angular orientation for the implement 32 that is to be maintained as the loader arms 36 are being moved. In such instance, the desired orientation may be selected or input by the operator using any suitable means that allows for the communication of such orientation to the controller 102. For example, the operator may be provided with a suitable input device(s) 130 (e.g., a button(s), touch screen, lever(s), etc.) that allows the operator to select/input a particular angle at which the implement 32 is to be maintained during movement of the loader arms 36, such as a specified angle defined relative to the vehicle's driving surface 34. In addition, or as an alternative thereto, the operator may be provided with a suitable input device(s) 130 (e.g., a button(s), touch screen, lever(s), etc.) that allows the operator to record or select the current angular orientation of the implement 32 as the desired orientation, which may then be stored within the controller's memory 106. Moreover, in one embodiment, one or more pre-defined implement orientation/position settings may be stored within the controller's memory 106. In such an embodiment, the operator may simply select one of the pre-defined orientation/position settings in order to instruct the controller 102 as to the desired orientation for the implement 32.

Moreover, as shown in FIG. 2, the controller 102 may also be communicatively coupled to one or more position sensors 132 for monitoring the position(s) and/or orientation(s) of the loader arms 36 and/or the implement 32. In several embodiments, the position sensor(s) 132 may correspond to one or more angle sensors (e.g., a rotary or shaft encoder(s) or any other suitable angle transducer) configured to monitor the angle or orientation of the loader arms 36 and/or implement 32 relative to one or more reference points. For instance, in one embodiment, an angle sensor(s) may be positioned at the forward pivot point 42 (FIG. 1) to allow the angle of the implement 32 relative to the loader arms 36 to be monitored. Similarly, an angle sensor(s) may be positioned at the rear pivot point 46 to allow the angle of the loader arms 36 relative to a given reference point on the work vehicle 10 to be monitored. In addition to such angle sensor(s), or as an alternative thereto, one or more secondary angle sensors (e.g., a gyroscope, inertial sensor, etc.) may be mounted to the loader arms 26 and/or the implement 32 to allow the orientation of such component(s) relative to the vehicle's driving surface 34 to be monitored.

In other embodiments, the position sensor(s) 132 may correspond to any other suitable sensor(s) that is configured to provide a measurement signal associated with the position and/or orientation of the loader arms 36 and/or the implement 32. For instance, the position sensor(s) 132 may correspond to one or more linear position sensors and/or encoders associated with and/or coupled to the piston rod(s) or other movable components of the cylinders 48, 50 in order to monitor the travel distance of such components, thereby allowing for the position of the loader arms 36 and/or the implement 32 to be calculated. Alternatively, the position sensor(s) 132 may correspond to one or more non-contact sensors, such as one or more proximity sensors, configured to monitor the change in position of such movable components of the cylinders 48, 50. In another embodiment, the position sensor(s) 132 may correspond to one or more flow sensors configured to monitor the fluid into and/or out of each cylinder 48, 50, thereby providing an indication of the degree of actuation of such cylinders 48, 50 and, thus, the location of the corresponding loader arms 36 and/or implement 32. In a further embodiment, the position sensor (s) 132 may correspond to a transmitter(s) configured to be coupled to a portion of one or both of the loader arms 36 and/or the implement 32 that transmits a signal indicative of the height/position and/or orientation of the loader arms/implement 36, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the loader arms 36 and/or the implement 32 to be monitored. For instance, in one embodiment, the work vehicle 10 may include both a first set of position sensors 132 (e.g., angle sensors) associated with the pins located at the pivot joints defined at the forward and rear pivot points 42, 46 for monitoring the relative angular positions of the loader arms 36 and the implement 32 and a second set of position sensors 132 (e.g., a linear position sensor(s), flow sensor(s), etc.) associated with the lift and tilt cylinders 48, 50 for monitoring the actuation of such cylinders 48, 50.

Additionally, as shown in FIG. 2, the controller 102 may also be coupled to one or more pressure sensors 134 configured to monitor the fluid pressure of the hydraulic fluid at one or more locations within the system 100. Specifically, in several embodiments, one or more pressure sensors 134 may be provided within and/or in association with the hydraulic tank 124 for monitoring the pressure of the hydraulic fluid within the tank 124 (hereinafter referred to as the "tank pressure"). Similarly, one or more pressure sensors 134 may be provided between the pump 125 and the valve(s) associated with the cylinder(s) 48, 50 (e.g., at a location between the pump 125 and the valve(s)) so as to monitor the pressure of the hydraulic fluid being supplied to the valve(s) (hereinafter referred to the "source pressure"). Moreover, one or more pressure sensors 134 may also be provided in association with each cylinder 48, 50. For example, in one embodiment, a pair of pressure sensors 134 may be associated with each cylinder 48, 50 so as to provide pressure measurements of the hydraulic fluid contained within the cap end 112, 120 and the rod end 114, 122 of each cylinder 48, 50 (hereinafter referred to as the "cap-end pressure" and the "rod-end pressure," respectively).

Moreover, as shown in FIG. 2, the controller 102 may be coupled to one or more temperature sensors 136 configured to monitor the temperature of the hydraulic fluid supplied between the tank 124 and the various cylinders 48, 50. In one embodiment, the temperature sensor(s) 136 may correspond to a temperature transducer(s) or other suitable sensor (s) configured to directly monitor the temperature of the hydraulic fluid. Alternatively, the temperature sensor(s) 136 may correspond to any other suitable sensor that provides an indirect indication of the fluid temperature of the hydraulic fluid. For instance, in a particular embodiment, the temperature sensor(s) 136 may correspond to a suitable sensor(s) configured to monitor the density or viscosity of the hydraulic fluid, which may then be utilized to determine the temperature of the hydraulic fluid.

It should be appreciated that the controller 102 may also be coupled to various other sensors for monitoring one or more other operating parameters of the work vehicle 10. For instance, the controller 102 may be coupled to one or more velocity sensors and/or accelerometers (not shown) for monitoring the velocity and/or acceleration of the loader arms 36 and/or the implement 32.

It should also be appreciated that, as used herein, the term "monitor" and variations thereof indicates that the various sensors of the system 100 may be configured to provide a direct or indirect measurement of the operating parameters being monitored. Thus, the sensors may, for example, be used to generate signals relating to the operating parameter being monitored, which can then be utilized by the controller 102 to determine or predict the actual operating parameter.

In addition, it should be appreciated that, as described herein, the controller 102 may be configured to receive a signal indicative of a given operating parameter or state of the work vehicle 10 from an external source (e.g., from a sensor coupled to the controller 102) or from an internal source. For example, signals transmitted to, within and/or from the processor(s) 104 and/or memory 106 of the controller 102 may be considered to have been "received" by the controller 102. Thus, in embodiments in which the controller 102 is utilizing a constant value for a given operating parameter of the work vehicle (e.g., the hydraulic pressure and/or the fluid temperature), a signal indicative of such operating parameter may be received by the controller 102 when the constant value is, for example, retrieved from memory by the processor(s) 104 and/or utilized by the processor(s) 104 as an input within a given processing step (e.g., when implementing the closed-loop control algorithm described below).

Figure 3:
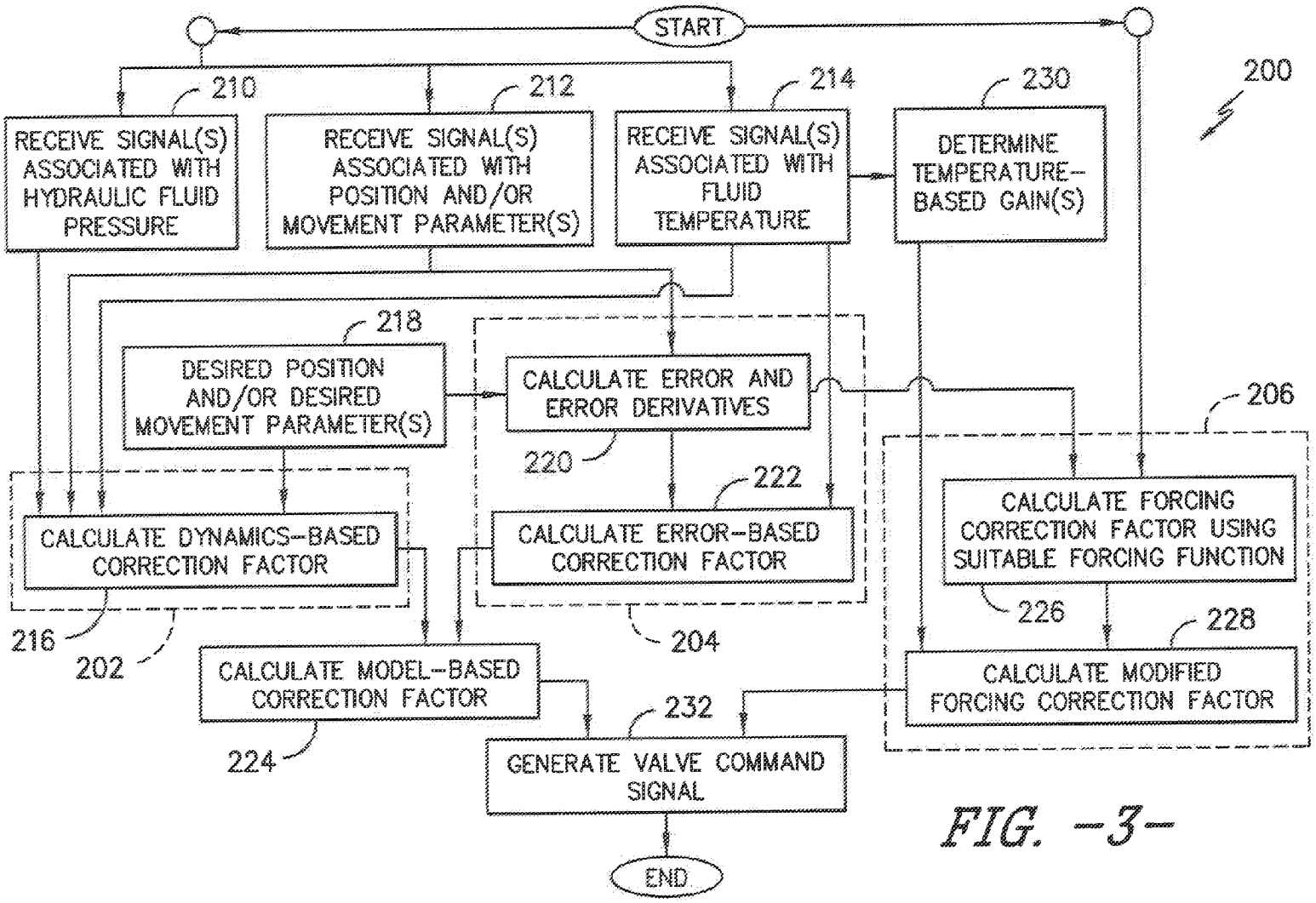
FIG. 3 illustrates a flow diagram of one embodiment of a closed-loop control algorithm that may be utilized by the control system shown in FIG. 2 in order to maintain an implement of a work vehicle at a constant angular orientation as the vehicle's loader arms are being moved in accordance with aspects of the present subject matter.

Referring now to FIG. 3, a flow diagram of one embodiment of a closed-loop control algorithm 200 that may be implemented by the controller 102 for maintaining a constant angular orientation of an implement 32 is illustrated in accordance with aspects of the present subject matter. Specifically, in several embodiments, the disclosed algorithm 200 may provide the work vehicle 10 with self-leveling functionality for the implement 32, thereby allowing the angular orientation of the implement 32 relative to the vehicle's driving surface 34 (or relative to any other suitable reference point) to be maintained constant as the loader arms 36 are being moved along their range of travel. For instance, the controller 102 may be configured to initially learn a desired angular orientation for the implement 32, such as by receiving an input from the operator (e.g., via a suitable input device 130) corresponding to the angle at which the implement 32 is to be maintained relative to the vehicle's driving surface 34. The controller 102 may then implement the closed-loop control algorithm 200 to allow control signals to be generated for controlling the operation of the vehicle's tilt valve(s) 116, 118 in a manner that maintains the implement 32 at the desired angular orientation as the loader arms 36 are rotated clockwise or counter-clockwise about the rear pivot point 46.

In several embodiments, the closed-loop control algorithm 200 may correspond to and/or may incorporate aspects of a sliding mode controller that employs both a feed-forward control portion (indicated by dashed box 202) and a feedback control portion (indicated by dashed box 204) to allow for enhanced positional control of the implement 32 as the loader arms 36 are being moved along their range of travel. Specifically, the feed-forward and feedback control portions 202, 204 of the algorithm 200 may generally be implemented by utilizing a control equation stored within the controller's memory 106 that is based on a mathematical model of the operational dynamics of the lift assembly 30. For example, the feed-forward control 202 may apply the control equation using one or more input signals to generate a dynamics-based correction factor (e.g., a dynamics-based command signal) that permits the control algorithm 200 to reduce delays within the system 100, thereby increasing the system's responsiveness in relation to controlling the tilt valves 116, 118 and the corresponding tilt cylinders 50 of the vehicle's lift assembly 30, which, in turn, allows for more precise and accurate control of the implement's orientation/position. In addition, the feedback control 204 may allow for an error-based correction factor (e.g., an error-based command signal) to be determined using the control equation that takes into account variables not accounted for by the feed-forward control 202. Moreover, the closed-loop control algorithm 200 may also include a forcing control portion (indicated by dashed box 206) to allow for a secondary correction factor (e.g., a forcing correction factor) to be calculated that takes into account inaccuracies within the base mathematical model (e.g., due to un-modeled system dynamics). The various correction factors calculated using the feed-forward, feedback and forcing control portions 202, 204, 206 may then be utilized to calculate a final output signal(s) (e.g., a final valve command signal(s)) that is transmitted to the vehicle's tilt valve(s) 116, 118 to allow the angular orientation of the implement 32 to be maintained at the desired orientation as the loader arms 36 are being moved.

As shown in FIG. 3, when implementing the closed-loop control algorithm 200, the associated controller 102 may be configured to receive signals indicative of a plurality of different operating parameters associated with the system 100 described above, which may then be utilized as input signals for the various control portions of the algorithm 200. For example, (at 210), a signal(s) may be received by the controller 102 that is indicative of one or more fluid pressures associated with the hydraulic fluid supplied to and/or within the various hydraulic components of the lift assembly 30. Specifically, as indicated above, the controller 102 may, in one embodiment, be communicatively coupled to one or more pressure sensors 134 that allow the controller 102 to monitor the fluid pressure of the hydraulic fluid at one or more locations along its flow path between the tank 124 and the corresponding cylinders 48, 50, such as the tank pressure and/or the source pressure of the hydraulic fluid supplied to the cylinders 48, 50 as well as the rod-end pressure and/or the cap-end pressure supplied within one or more of the cylinders 48, 50. Alternatively, a predetermined pressure value(s) may be stored within the controller 102 and utilized as the pressure input(s) into the disclosed algorithm 200.

Additionally, as shown in FIG. 3, (at 212), a signal(s) may be received by the controller 102 that is indicative of one or more position and/or movement parameters associated with the lift assembly 30. As used herein, the term "movement parameter" may generally correspond to the velocity of the loader arms 36 and/or the implement 32 and its derivatives (the acceleration, the rate of change of acceleration and/or further derivatives). As indicated above, the controller 102 may be communicatively coupled to one or more position sensors 132 that allow the controller 102 to continuously monitor the position of the loader arms 36 and/or the implement 32. In addition, by monitoring the position of such component(s), the controller 102 may also be configured to monitor one or more of the movement parameters associated with the component(s). Specifically, by monitoring the change in position of the loader arms 36 and/or the implement 32 over time, the velocity, acceleration and/or the rate of change of the acceleration (and/or further derivatives) of such component(s) may be estimated or calculated by the controller 102. Alternatively, one or more of the movement parameters may be measured directly, such as by using velocity sensors and/or accelerometers to monitor the velocity and/or the acceleration of the loader arms 36 and/or the implement 32.

Moreover, (at 214), a signal(s) may be received by the controller 102 that is indicative of one or more fluid temperatures associated with the hydraulic fluid supplied to and/or within the various hydraulic components of the lift assembly 30. Specifically, as indicated above, the controller 102 may be communicatively coupled to one or more temperature sensors 136 that allow the controller 102 to directly or indirectly monitor the temperature of the hydraulic fluid at one or more locations along its flow path between the tank 124 and the corresponding cylinders 48, 50. For instance, the temperature sensor(s) 136 may be disposed immediately downstream of the pump 125 for monitoring the temperature of the fluid being supplied to each cylinder 48, 50. Alternatively, a predetermined temperature value(s) may be stored within the controller 102 and utilized as the temperature input(s) into the disclosed algorithm 200.

The various input signal(s) associated with the operating parameter(s) (e.g., the pressure signal(s), the position/movement parameter signal(s) and/or the temperature signals(s)) may then be utilized within the separate control portions 202, 204, 206 of the closed-loop algorithm 200 to allow for the calculation of correction factors (i.e., valve commands) for correcting the position of the implement 32. For example, as shown in FIG. 3, (at 216), the feed-forward control portion 216 may be configured to utilize the pressure signal(s), the position/movement parameter signal(s) and/or the temperature signals(s) to calculate a dynamics-based correction factor. As indicated above, such correction factor may be calculated using a control equation that is developed based on a base mathematical model of the operational dynamics of the lift assembly 30. Specifically, the base model may be configured to model the operation of the lift assembly 30 while taking into account the various dynamics impacting the interaction between the loader arms 36 and the implement 32 with respect to their positioning/movement, including, but not limited to, the loading on the implement 32, the variability of operator-generated input command(s) for moving the loader arms 36, environmental factors, inefficiencies within the hydraulic system (e.g., pressure losses within the system 100) and/or the like. In such instance, the input signals associated with the operating parameters may allow for such system dynamics to be accounted for within the model. For example, the monitored fluid pressure(s) may provide an indication of the loading on the implement 36 and/or the inefficiencies within the hydraulic system whereas the monitored fluid temperature (s) may provide an indication of one or more environmental factors, such as density or viscosity changes of the hydraulic fluid due to varying fluid temperatures.

It should be appreciated that the particular mathematical model utilized to model the operational dynamics of a vehicle's lift assembly 30 may generally be developed using any suitable means, such as through experimental trials conducted on a work vehicle 10, through computer-aided modeling of a work vehicle 10 and/or by deriving the model mathematically. For example, the model may be derived using several techniques including, but not limited to, a Newton method or an empirical method. Such development techniques are well within the purview of one ordinary skill in the art and, thus, will not be described herein in any detail. In addition, it should be appreciated that the mathematical model used in accordance with aspects of the present subject matter may generally vary based on differing work vehicle configurations, particularly with respect to differing lift assembly configurations.

It should also be appreciated that various constants may be utilized within the mathematical model to account for the specific design/configuration of a given work vehicle 10. For example, machine-specific parameters that vary from vehicle-to-vehicle configuration but are constant for a given work vehicle configuration may include, but are not limited to, the cross-sectional area of the rod-end 114, 122 of each cylinder 48, 50, the cross-sectional area of the cap-end 112, 120 of each cylinder 48, 50, the cross-sectional area of the valve orifice(s) of each valve 108, 110, 116, 118, the size and design parameters of the pump 125, the specific parameters associated with the hydraulic fluid (e.g., the bulk modulus and/or the coefficient of discharge associated with the fluid) and/or the like. Such constants may, for example, be utilized for a given work vehicle 10 within the model to allow for the calculation of the correction factors described herein.

Additionally, in several embodiments, when utilizing the control equation to determine the dynamic-based correction factor, the control equation may be configured to apply the mathematical model in an inverse manner. For example, the base model may be originally developed such that, for a given valve command signal, a corresponding position and/or movement parameter is output for the implement 32. However, in accordance with aspects of the present subject, a desired position and/or movement parameter for the implement 32 (e.g. from box 218) may be input into the control equation so as to determine the corresponding valve command signal(s) that is required to be transmitted to the tilt valve(s) 116, 118 in order to obtain such desired position/movement parameter. Thus, based on the desired position/movement parameter for the implement 32 and the various input signals, the controller 102 may calculate an appropriate valve command signal(s) for the tilt valve(s) 116, 118, which corresponds to the dynamics-based correction factor.

It should be appreciated that the desired position/movement parameter for the implement 32 may generally correspond to the specific position at which the implement 32 must be located and/or the specific manner in which the implement 32 must be moved based on the current position/movement of the loader arms 36 in order to maintain the implement 32 at the desired angular orientation. Specifically, given the geometry and the mechanics of the lift assembly 30, the position/movement parameter of the implement 32 may need to be adjusted constantly as the position/movement parameter of the loader arms 36 changes. Thus, the desired position/movement parameter for the implement 32 may be determined based on the monitored position/movement parameter for the loader arms 36 (e.g., as provided at 212). For instance, the current loader arm position/movement parameter may be used within a suitable algorithm or data table (e.g., a look-up table) to determine the corresponding implement position/movement parameter required to maintain the desired angular orientation of the implement 32 as the loader arms 36 are being moved, which may then be used as the signal output from box 218.

Referring still to FIG. 3, as indicated above, the closed-loop control algorithm 200 may also include a feedback control portion 206 that allows for an error-based correction factor to be calculated. Specifically, in several embodiments, (at 220), one or more error signals may be generated based on the difference between the monitored position/movement parameter for the implement 32 (as provided from box 212) and the desired position/movement parameter for the implement 32 (as provided from box 218). For example, in one embodiment, initial error signals may be generated based on the difference between the actual and desired position, velocity, acceleration and/or rate of change of acceleration of the implement 32. In addition, for each initial error signal generated, one or more derivative error signals may be generated based on the change in the error over time. For instance, in one embodiment, a first derivative error signal corresponding to first derivative of the error (i.e., the rate of change of the error) and a second derivative error signal corresponding to the second derivative of the error (i.e., the derivative of the rate of change of the error) may be calculated for each initial error signal generated.

The error signal(s) (and, optionally, the temperature signal (s) from 214) may then be utilized (at 222) to calculate an error-based correction factor corresponding to a valve command signal for adjusting the position of the implement 32 based on the identified error(s) within the system 100. Similar to the dynamics-based correction factor, the error-based correction factor may also be calculated using the control equation developed based on the mathematical model of the operational dynamics of the lift assembly 30. For example, as will be described below, a portion of the control equation may allow for the calculation of the dynamics-based correction factor whereas another portion of the control equation may allow for the calculation of the error-based correction factor.

As shown in FIG. 3, the correction factors generated by the feed-forward and feedback control portions 202, 204 of the closed-loop control algorithm 200 may then be utilized (at 224) to calculate an overall model-based correction factor that corresponds to the valve command signal that is required to be transmitted to the tilt valve(s) 116, 118 in order to obtain the desired position/movement parameter for the implement 32 based on the modeled dynamics of the lift assembly 30. Specifically, in several embodiments, the dynamics-based correction factor provided by the feed-forward control portion 202 and the error-based correction factor provided by the feedback control portion 204 may be combined to generate the model-based correction factor. In doing so, it should be appreciated that the correction factors may be combined or otherwise processed in any suitable manner in order to calculate the model-based correction factor. For instance, in one embodiment, the error-based correction factor and the dynamics-based correction factor may be added together, with the resulting sum corresponding to the final model-based correction factor.

Referring still to FIG. 3, as indicated above, the forcing control portion 206 of the closed-loop algorithm 200 may generally be configured to determine a forcing correction factor that accounts for inaccuracies within the mathematical model used to derive the control equation, including inaccuracies related to system dynamics that were not taken into account by the model. Specifically, un-modeled system dynamics typically result in additional control error(s) within the system that may result in the system becoming unstable. To account for this, a sliding surface may be chosen to be used together with the control equation that is based on the order of the original system such that, as long as the system is maintained on the sliding surface, the global asymptotic stability of the system may be guaranteed. Thus, the forcing control portion 206 may be utilized to drive the error(s) introduced into the system as a result of such un-modeled dynamics to zero, thereby ensuring that the system is maintained on the sliding surface so as to increasing the system's accuracy and stability with respect to controlling the position of the implement 32 as the loader arms 36 are being moved.

For example, as shown in FIG. 3, (at 226), the error signal(s) calculated based on the difference between the actual and desired position/movement parameter(s) for the implement 32 may be input into a suitable forcing function that incorporates a sliding surface equation configured to generate a forcing correction factor for driving the error(s) within the system to zero. Specifically, in several embodiments, the forcing function may correspond to a sign function that generates a forcing correction factor based on the sign of the sliding function (either positive (+) or negative (−)) so as to drive the system onto the sliding surface. For instance, if the output of the sliding surface equation is positive (e.g., when the error and its derivatives are positive, such as when the actual position is greater than the desired position), the forcing correction factor may correspond to a correction signal designed to drive the error in the negative direction s as to move the system back onto the sliding surface. Similarly, if the output of the sliding surface equation is negative (e.g., when the error and its derivatives are negative, such as when the actual position is less than the desired position), the forcing correction factor may correspond to a correction signal designed to drive the error in the positive direction back onto the surface.

In an alternative embodiment, the forcing function may correspond to a saturation function that seeks to maintain the output of the sliding surface equation within an error tolerance band defined around zero, such as by defining a maximum error and a minimum error corresponding to a zero error plus/minus the predetermined error tolerance. In such an embodiment, when the error(s) falls within the pre-defined error tolerance band, the forcing correction factor may correspond to zero. However, when the output of the sliding surface equation reaches or exceeds the maximum or minimum error defined for the error tolerance band, the forcing factor may correspond to a correction signal designed to drive the system in the opposite direction towards the sliding surface. Such a saturation-based forcing function may generally result in less control variability than the sign-based forcing function since the sign-based forcing function attempts to correct the error each time it crosses over zero whereas the saturation-based forcing function only attempts to correct the error when it reaches the maximum or minimum error defined for the error tolerance band.

Additionally, as shown in FIG. 3, the forcing correction factor generated using the forcing function may, in several embodiments, be modified (at 228) using a temperature-based gain to create a modified forcing correction factor (i.e., a modified valve command signal) that accounts for variations of the density of the hydraulic fluid due to temperature fluctuations and can also be used to change the bandwidth of the system (λ), which is also a factor of temperature. Specifically, (at 230), a temperature-based gain may be calculated based on the monitored fluid temperature. For instance, a suitable algorithm or data table (e.g., a look-up table) may be used to determine a control gain given the current temperature of the hydraulic fluid. Such gain may then be utilized to modify the forcing correction factor (e.g., by using the gain as a multiplier) to calculate the modified forcing correction factor.

Referring still to FIG. 3, the correction factors calculated at 224 and 228 may then be used (at 232) to generate a final valve control command for controlling the operation of the tilt valve(s) 116, 118. Specifically, in several embodiments, the model-based correction factor and the modified forcing correction factor may be combined (e.g., by adding the two correction factors together) to produce a final valve control command(s). The control command may then be transmitted to the tilt valve(s) 116, 118 in order to control the operation of the valve(s) 116, 118 in a manner that causes the implement 32 to be maintained at the desired angular orientation relative to the vehicle's driving surface 34 (or relative to any other reference point) as the loader arms 36 are being moved along their range of travel.

It should be appreciated that, in the flow diagram of FIG. 3, the temperature signal(s) derived from 214 is shown as being utilized as an input(s) for calculating each of the various correction factors. However, in other embodiments, the temperature signal(s) may only correspond to an optional input signal(s) for each of the various control portion of the control algorithm 200 or may not be taken into account at all in calculating the correction factors.

As indicated above, in several embodiments, the closed-loop control algorithm 200 may implement or incorporate aspects of a sliding mode controller. Specifically, a sliding mode controller may be particularly well suited for providing self-leveling functionality for the implement 32 due to the highly non-linear behavior and uncertainties present in modeling the operational dynamics of a vehicle's lift assembly 30. For example, in a particular embodiment, after modeling the operational dynamics of the system, a sliding mode control equation may be designed based on the mathematical model, with the sliding surface of the sliding mode control being selected so as to drive the system or control error to zero over time. In particular, the overall control design may be expressed according to the following equation (Equation 1):

$$u(t)=\hat{u}(t)+K(x,t)F(S,\emptyset) \tag{1}$$

wherein, u(t) corresponds to the output of the controller 102 (e.g., the final valve command signal), û(t) corresponds to the control equation incorporating aspects of the modelled operational dynamics of the system 100 (as represented below in Equation 2), K corresponds to a function used to calculated the gains for the system 100, x corresponds to the system state(s) (e.g., such as pressure, position, velocity, acceleration and/or temperature), t corresponds to time, F corresponds to the forcing function to be applied, S corresponds to the sliding surface used for the sliding mode controller as represented below in Equation 3 and Ø corresponds to the boundary limits defined for the system 100.

It should be appreciated that the gains calculated using the function (K) within Equation 1 may generally correspond to multipliers used to stabilize the system 100 and may be calculated based on the uncertainty of the dynamic model.

It should also be appreciated that the boundary limits (Ø) utilized within Equation 1 may, in one embodiment, correspond to the error band or tolerance associated with the forcing function (F). In such embodiments, the boundary limits may be calculated based on the maximum acceptable error selected for the system.

When utilizing Equation 1, the control equation (û(t)) may, in several embodiments, be represented according to the following equation (Equation 2):

$$\hat{u}(t)=\frac{M(\dddot{x}_d-3\lambda\ddot{e}-3\lambda^2\dot{e}-3\lambda^3 e)+B\ddot{x}+(A_{cap}-A_{rod})3\dot{x}}{3x_{cap}C_dF(P_S,P_c,P_t,\rho)+3x_{rod}C_dF(P_S,P_r,P_t,\rho)} \tag{2}$$

wherein, M corresponds to the mass of the loader system, $\dddot{x}_d$ corresponds to the third derivative of the desired position of the implement 32 ($x_d$), λ corresponds to the bandwidth of the system 100, e corresponds to the calculated control error (e.g., the error calculated between the actual and desired implement position and/or between the actual and desired implement movement parameter), ė corresponds to the first derivative of the control error (e), ë corresponds to the second derivative of the error (e), B corresponds to the Bulk Modulus associated with the hydraulic fluid, 2 corresponds to the second derivative (acceleration) of the actual position of the implement 32 (x), $A_{cap}$ corresponds to the cross-sectional area of the cap-end 120 of the relevant cylinder(s), $A_{rod}$ corresponds to the cross-sectional area of the rod-end 122 of the relevant cylinder(s), ẋ corresponds to the first derivative (velocity) of the of the actual position of the implement 32 (x), $x_{cap}$ corresponds to the position of the cylinder piston referenced from the cap-end of the relevant cylinder(s), $C_d$ corresponds to the coefficient of discharge of the hydraulic fluid supplied within the various system cylinders, $F(P_S, P_c, P_t, \rho)$ corresponds to a function that indicates the flow dynamics to the cap-end of the relevant cylinder(s) based on the source pressure ($P_S$) of the hydraulic fluid, the cap-end pressure ($P_c$) within the relevant cylinder(s), the tank pressure ($P_t$) and the density (ρ) of the hydraulic fluid, $x_{rod}$ corresponds to corresponds to the position of the cylinder piston referenced from the rod-end of the relevant cylinder(s), and $F(P_S, P_r, P_t, \rho)$ corresponds to a function that indicates the flow dynamics to the rod-end of the relevant cylinder(s) based on the source pressure ($P_S$) of the hydraulic fluid, the rod-end pressure ($P_r$) within the tilt cylinder(s) 50, the tank pressure ($P_t$) and the density (ρ) of the hydraulic fluid.

It should be appreciated that the bandwidth (λ) of the system 100 may generally be determined experimentally or by using dynamic modelling.

It should also be appreciated that the various functions ($F(P_S, P_c, P_t, \rho)$ and $F(P_S, P_r, P_t, \rho)$) may be developed using dynamic modelling or empirically using test data.

Additionally, when utilizing Equation 1, the sliding surface (S) may, in several embodiments, be represented according to the following equation (Equation 3):

$$S=\ddot{e}+3\lambda\dot{e}+3\lambda^2 e+\lambda^3\int e \tag{3}$$

wherein, λ corresponds to the bandwidth of the system, e corresponds to the calculated control error (e.g., the error calculated between the actual and desired implement position and/or between the actual and desired implement movement parameter), ė corresponds to the first derivative of the control error (e) and ë corresponds to the second derivative of the error (e).

It should be appreciated that the design control equation (s) provided above may be configured to incorporate both the feed-forward and the feed-back control portions 204 described above with reference to FIG. 2. For example, the feed-forward control portion 202 of the closed-loop control algorithm 200 is generally represented by the following portion of Equation 2:

$$\frac{M(\ddot{x}_d)+B\dot{x}+(A_{cap}-A_{rod})3\dot{x}}{3x_{cap}C_dF(P_S, P_c, P_t, \rho)+3x_{rod}C_dF(P_S, P_r, P_t, \rho)}$$

Similarly, the feedback control portion 200 of the closed-loop control algorithm 200 is generally represented by the following portion of Equation 2:

$$\frac{M(-3\lambda\ddot{e}-3\lambda^2\dot{e}-3\lambda^3 e)}{3x_{cap}C_dF(P_S, P_c, P_t, \rho)+3x_{rod}C_dF(P_S, P_r, P_t, \rho)}$$

It should also be appreciated that, although the equations provided above (e.g., Equations 1-3) incorporate aspects of a sliding mode control algorithm, the control equation utilized within the disclosed closed-loop system may, in alternative embodiments, incorporate aspects of any other suitable control algorithm. Thus, one of ordinary skill in the art should understand that the present subject matter need not be limited to control equations implementing a sliding mode controller.

Additionally, it should be appreciated that, as indicated above, the present subject matter is directed to various methods for automatically adjusting the position of an implement of a lift assembly for a work vehicle. Such methods may include, for example, any combination of the various control steps described above with reference to FIG. 3 and/or any other suitable method limitations consistent with the disclosed provided herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for automatically adjusting a position of an implement of a lift assembly for a work vehicle, the lift assembly comprising a pair of loader arms coupled to the implement, the method comprising:

receiving, with a computing device, a signal indicative of a user-selected orientation of the implement of the lift assembly for the work vehicle;

receiving, with the computing device, a signal indicative of at least one of a position or a movement parameter of the loader arms as the loader arms are being moved;

receiving, with the computing device, a signal indicative a fluid pressure of a hydraulic fluid supplied within the lift assembly;

accessing, with the computing device, a control equation that is based at least partially on a model of operational dynamics associated with the lift assembly when moving the loader arms;

calculating, with the computing device, a first correction signal associated with adjusting the position of the implement, the first correction signal being calculated at least partially by inputting the at least one of the position or the movement parameter and the fluid pressure into the control equation;

calculating, with the computing device, a second correction signals associated with adjusting the position of the implement, the second correction signal being calculated at least partially by inputting an error signal into the control equation, the error signal being determined based at least in part on a difference between the at least one of the position or the movement parameter for the implemented and at least one of a desired position or a desired movement parameter for the implement;

calculating, with the computing device, a forcing correction signal by inputting the error signal into a forcing function to account for un-modeled operational dynamics of the control equation, the forcing correction signal differing from the second correction signal;

generating, with the computing device, a valve command signal based at least in part on the first correction signal, the second correction signal, and the forcing correction signal; and transmitting, with the computing device, the valve command signal to a valve associated with the implemented in order to maintain the implement at the user-selected orientation relative to a given reference point as the loader arms are being moved.

2. The method of claim 1, wherein the movement parameter comprises at least one of a velocity, an acceleration or a rate of change of the acceleration.

3. The method of claim 1, wherein the fluid pressure corresponds to at least one of a rod-end pressure, a cap-end pressure, a source pressure or a tank pressure associated with the hydraulic fluid supplied to a hydraulic cylinder of the lift assembly.

4. The method of claim 1, further comprising receiving, with the computing device, a signal indicative of a fluid temperature of the hydraulic fluid.

5. The method of claim 4, wherein the first correction signal is calculated at least partially by inputting the at least one of the position or the movement parameter, the fluid pressure and the fluid temperature into the control equation.

6. The method of claim 1, further comprising calculating a model-based correction signal associated with adjusting the position of the implement based at least in part on the first and second correction signals.

7. The method of claim 6, wherein generating the valve command signal comprises generating the valve command signal based at least in part on the model-based correction signal and the forcing correction signal.

8. The method of claim 1, wherein the forcing function corresponds to a sign function or a saturation function.

9. The method of claim 1, further comprising:

receiving, with the computing device, an indication of a fluid temperature of the hydraulic fluid;

determining, with the computing device, a control gain based at least in part on the fluid temperature; and modifying, with the computing device, the forcing correction signal based on the control gain to generate a modified forcing correction signal.

10. The method of claim 9, wherein generating the valve command signal comprises generating the valve command signal based at least in part on the first correction signal, the second correction signal, and the modified forcing correction signal.

11. The method of claim 1, wherein the control equation corresponds to a sliding mode control algorithm.

12. A method for automatically adjusting a position of an implement of a lift assembly for a work vehicle, the lift assembly comprising a pair of loader arms coupled to the implement, the method comprising:

receiving, with a computing device, a signal indicative of at least one of a position or a movement parameter of the loader arms and the implement as the loader arms are being moved;

calculating, with the computing device, an error signal based at least in part on a difference between the at least one of the position or the movement parameter for the implement and at least one of a desired position or a desired movement parameter for the implement; and receiving, with the computing device, a signal indicative of a fluid pressure of a hydraulic fluid supplied within the lift assembly;

accessing, with the computing device, a control equation that is based at least partially on a model of operational dynamics associated with the lift assembly when moving the loader arms, the control equation corresponding to a sliding mode control algorithm;

generating, with the computing device, a model-based correction signal associated with adjusting the position of the implement, the model-based correction signal being generated at least partially by inputting the at least one of the position or the movement parameter for the loader arms, the fluid pressure, and the error signal into the control equation;

calculating, with the computing device, a forcing correction signal by inputting the error signal into a forcing function to account for un-modeled operational dynamics of the control equation, the forcing correction signal differing from the model-based correction signal;

generating, with the computing device, a valve command signal based at least in part on the model-based correction signal and the forcing correction signal; and transmitting, with the computing device, the valve command signal to a valve associated with the implement in order to maintain the implement at a user-selected orientation relative to a given reference point as the loader arms are being moved.

13. The method of claim 12, wherein the forcing function corresponds to a sign function or a saturation function.

14. The method of claim 12, further comprising:

receiving, with the computing device, a signal indicative of a fluid temperature of the hydraulic fluid;

determining, with the computing device, a control gain based at least in part on the fluid temperature; and modifying, with the computing device, the forcing correction signal based on the control gain to generate a modified forcing correction signal.

15. The method of claim 14, wherein generating the valve command signal comprises generating the valve command signal based at least in part on the model-based correction signal and the modified forcing correction signal.

16. The method of claim 12, further comprising receiving, with the computing device, a signal indicative of a fluid temperature of the hydraulic fluid, wherein the model-based correction signal is calculated at least partially by inputting the at least one of the position or the movement parameter for the loader arms, the fluid pressure, the error signal and the fluid temperature into the control equation.

17. The method of claim 12, further comprising:

determining a dynamics-based correction factor based at least in part by inputting the fluid pressure and the at least one of the position or the movement parameter into the control equation; and determining an error-based correction factor based at least in part inputting the error signal into the control equation, the error-based correction factor differing from the forcing correction signal, wherein generating the model-based correction signal comprises detern the model-based correction signal based at least in part on the dynamics-based correction factor and the error-based correction factor.

18. The method of claim 17, wherein the dynamics-based correction factor is determined based on a feed-forward control portion of the control equation and the error-based correction factor is determined based at least in part on a feed-back control portion of the control equation.

* * * * *